United States Patent [19]

Dalbo et al.

[11] Patent Number: 4,978,008

[45] Date of Patent: Dec. 18, 1990

[54] YARN COLOR ORGANIZER FOR NEEDLECRAFT PROJECT

[75] Inventors: Emil J. Dalbo; Loraine E. Dalbo, both of Tucker, Ga.

[73] Assignee: Dal-Craft, Inc., Tucker, Ga.

[21] Appl. No.: 362,208

[22] Filed: Jun. 6, 1989

[51] Int. Cl.[5] ..... B65D 85/67; B65H 75/06

[52] U.S. Cl. ..... 206/574; 206/225; 206/49; 223/106

[58] Field of Search ..... 206/225, 226, 227, 380, 206/382, 388, 574, 44.11, 49, 818; 223/109 R, 109 A, 106

[56] References Cited

U.S. PATENT DOCUMENTS

| | | | |
|---|---|---|---|
| 613,324 | 11/1898 | Selcer | 206/388 |
| 1,987,159 | 1/1935 | Rasmussen | 206/388 |
| 2,043,118 | 6/1936 | Protz | 206/388 |
| 3,856,140 | 12/1974 | Fitts | 206/388 |
| 3,949,452 | 4/1976 | Henderson | 206/388 |
| 4,264,011 | 4/1981 | Dalbo et al. | 206/574 |
| 4,310,313 | 1/1982 | Brundige | 206/574 |
| 4,380,296 | 4/1983 | Murray et al. | 206/388 |
| 4,391,370 | 7/1983 | Dalbo | 206/227 |
| 4,664,302 | 5/1987 | Dalbo et al. | 206/574 |

FOREIGN PATENT DOCUMENTS

| | | | |
|---|---|---|---|
| 0590933 | 10/1932 | Fed. Rep. of Germany | 206/44.11 |
| 0398351 | 9/1933 | United Kingdom | 206/44.11 |

*Primary Examiner*—Paul T. Sewell
*Assistant Examiner*—Jacob K. Ackon, Jr.
*Attorney, Agent, or Firm*—James B. Middleton

[57] ABSTRACT

A yarn organizer holds the different colors of yarn required for a needlcraft project. The organizer is in the form of a flat card member having holes adjacent to the edges of the card. The holes are uniformly spaced from the edges and uniformly spaced apart, to maintain the rigidity of the card. The holes are of different diameters for convenience in holding different sizes of bundles of yarn. One surface of the card is adapted for writing so an identification of the yarns can be placed on the card adjacent to each hole.

7 Claims, 1 Drawing Sheet

YARN COLOR ORGANIZER FOR NEEDLECRAFT PROJECT

INFORMATION DISCLOSURE STATEMENT

There are numerous yarn and floss organizers for use by people doing various forms of needlecraft. One form of organizer comprises a device around which the yarn is wrapped, each different color being wrapped around a different device, or a different area of one device. Another form of organizer comprises a generally flat member of cardboard, plastic sheet or the like, the flat member having a plurality of holes therein. Each different color of yarn is then looped and knotted through a separate hole. Both forms of organizers have met with considerable commercial success.

One of the latter form of organizer is shown in U.S. Pat. No. 4,264,011, the organizer being shown in FIG. 9 where it will be seen that the device has a plurality of holes along one edge for receiving bundles of floss. This and similar organizers are well adapted to store quantities of yarn or floss for general use; however, there are some special situations for which this device is not well adapted. All of such organizers include a plurality of holes through which bundles of yarn pass, but all the holes in each device are of the same size.

Many needlecraft workers now purchase kits for specific needlecraft projects. These kits generally include everything needed for one project, including the backing, complete instructions, and all the yarn or floss required for the project. It will be understood that such projects may require a large number of different colors of yarn; and, some colors may comprise a large bundle, while other colors may comprise as little as a single strand. Furthermore, some of the "different" colors of yarn may vary by a small difference in saturation or intensity so that the "different" colors are difficult to detect by normal visual inspection.

It is typical in a needlecraft kit of the type mentioned above to have a list of the different colors of yarn. The list itemizes the colors by numbers, by individual bundles, and may give the color name, a code number for the color, and the number of lengths of yarn for each color. Some of the colors may be so similar that the only means for distinguishing the colors is by the number of lengths in a particular bundle. Thus, once the bundles are broken, it becomes almost impossible for the ordinary person to sort the colors as required to complete the project.

The prior art yarn or floss organizers are not well adapted to use with the needlecraft kit in view of the great variation in the sizes of the final bundles of yarn. Since the holes in prior art organizers are the same size, one bundle may be so small as to become merged with another and effectively lost, while another bundle may be so large that it simply will not fit on the device.

SUMMARY OF THE INVENTION

This invention relates generally to yarn organizers, and is more particularly concerned with a yarn organizer for use with a needlecraft kit for separating the bundles of different colors as used in the kit.

The present invention provides a generally flat card or the like having a plurality of holes therein for receiving bundles of yarn or floss, the holes being of different sizes for receiving different sizes of bundles of yarn or floss. With the variation in hole size, it is important to maintain the integrity of the card, so distance between holes is maintained large enough to provide the desired strength, and the distance from the hole to the edge of the card is maintained large enough for the desired strength.

Though the card may be formed of many materials, it is preferable that the surface be such as to allow writing thereon for recording information to identify the yarn or floss in each hole.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
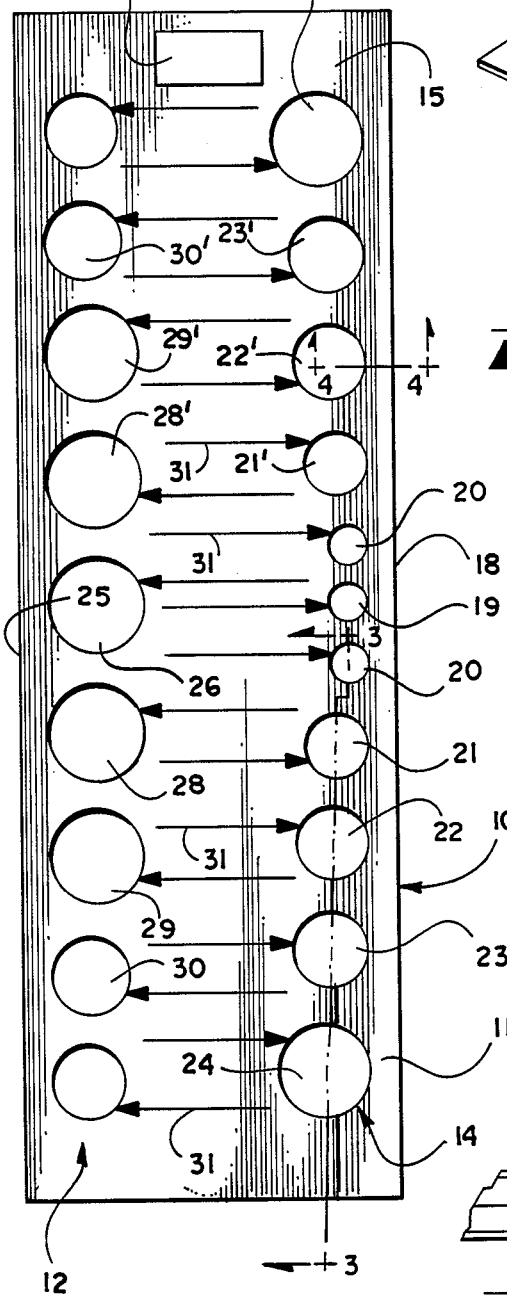
FIG. 1 is a front elevational view of an organizer made in accordance with the present invention.

Referring now more particularly to the drawings, and to that embodiment of the invention here presented by way of illustration, FIG. 1 shows a front view of a yarn or floss organizer generally designated at 10. It should be realized by those skilled in the art that there are various forms of strands referred to as yarn, floss, thread etc., the strands varying in diameter, hardness of twist and other physical characteristics. The device of the present invention is intended for use with all forms of strands used in needlework, the only changes required being possibly a change in the size of the organizer and the size of the holes in the organizer. For purposes of the present description, all such strands shall be referred to as yarn, and it will be understood that this term includes all strands used in needlework, though normally referred to by a different name.

The yarn organizer 10 shown in FIG. 1 comprises a generally rectangular card 11 having a first plurality of holes 12 generally along one edge of the card 11, and a second plurality of holes 14 generally along the opposite edge of the card 11. These holes 12 and 14 are to receive bundles of yarn looped therethrough and knotted therein, and this will be discussed in more detail hereinafter.

At the upper end 15 of the card 11, and located centrally thereof, a magnet strip 16 is provided. The strip 16 constitutes a needle holder for the organizer 10. It will be understood that a person may have two or more needles threaded with different colors of yarn, and at least one of these needles can be held by the strip while the other is in use. It will be obvious that a conventional pin-cushion material or the like may be substituted for the magnet, the object being to hold one or more needles temporarily.

Looking now at the plurality of holes 14 in the card 11, it will be noted that all the holes are spaced evenly from the edge 18 of the card 11. This is important in view of the fact that the individual holes in the plurality of holes 14 are of different diameters. One would conventionally align the hole centers with one another; but, since the yarn is to be looped between the hole and the edge 18 of the card 11, it is important to maintain a proper distance for both convenience and strength.

In the plurality of holes 14, the center hole 19 is the smallest hole, designed to receive a bundle of yarn of only a few strands. The next hole below the hole 19, hole 20, is slightly larger than the hole 19, to receive a slightly larger bundle of yarns. Successive holes 21—24 are successively larger, each not necessary that the increment be uniform, the object being to accommodate the bundles of yarn that may be in any selected kit or the like.

In the embodiment of the invention here presented, the plurality of holes 14 is symmetrical about the horizontal centerline of the card 11. Thus, the remaining holes will not be described in detail, and the like holes carry primes of the same numerals as the holes 20—24.

The plurality of holes 12 in the card 11 is also uniformly spaced from the edge 25 of the card 11. Whereas, in the plurality of holes 14, the center hole 19 is the smallest, the center hole in the plurality of holes 12 is one of the largest. The center hole is designated at 26, and is on the horizontal centerline of the card 11, hence aligned with the hole 19. The hole 28, below the hole 26, is of the same diameter as the hole 26, and the next hole 29 is also of the same diameter. The following hole, 30 is somewhat smaller and the next hole 31, is smaller than the hole 30.

As with the plurality of holes 14, the plurality of holes 12 is symmetrical, and the holes above the hole 26 carry the primes of the same numerals as the holes below the hole 26.

While the specific arrangement of the pluralities of holes 12 and 14 is subject to considerable variation, the present invention contemplates the use of an arrangement for maintaining sufficient strength in the card 11. Thus, the provision of the smallest hole in the plurality 14 at the center of the card 11, and increasing diameters away from the center, with an opposite arrangement for the plurality 12, maintains adequate spacing between the two pluralities without an excessively large card 11. This space provides both strength of the card 11 and space for identification indicia for the yarns.

Figure 3:
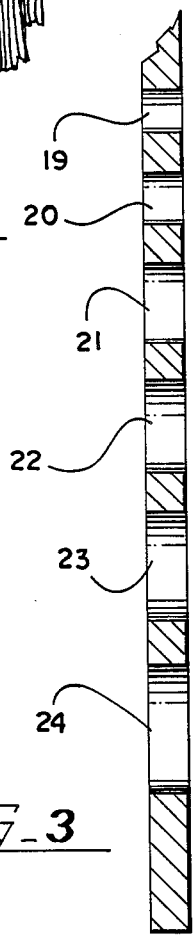
FIG. 3 is an enlarged cross-sectional view taken substantially along the line 3—3 in FIG. 1; and, FIG. 4 is an enlarged cross-sectional view taken substantially along the line 4—4 in FIG. 1.
Figure 4:
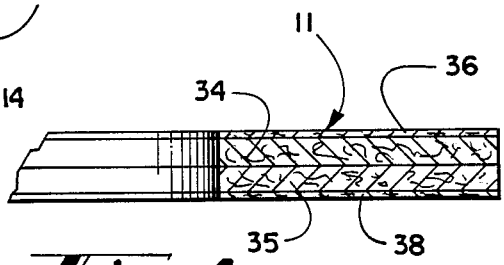

Other features contributing to the strength of the card 11 are the generally uniform spaces between the edge 18 and the holes 14, and between the edge 25 and the holes 12, and the generally uniform spacing between successive holes in each plurality of holes. FIG. 3 of the drawings is a cross-sectional view taken longitudinally through the card 11, along diameters of holes in the plurality of holes 14, and showing the substantially equal spacing of the individual holes. Similarly, FIG. 4 shows the distance of the plurality of holes 14 from the edge 18 of the card 11.

Figure 2:
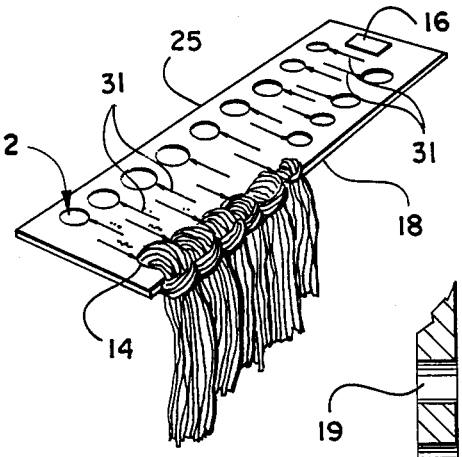
FIG. 2 is a perspective view of the organizer shown in FIG. 1 with a plurality of bundles of yarn received on the organizer.

Attention is now directed to FIG. 2 of the drawings which illustrates an organizer 10 having a plurality of bundles of yarn received thereon. It will be noticed that the hole 19 receives a single strand of yarn, while the larger holes receive substantial bundles of yarn. Due to the variety of sizes of holes, any given bundle of yarns should be receivable in a hole of an appropriate size for that bundle.

For some needlecraft kits, there may be one color of yarn having so many strands that the bundle will not fit in one hole. In this event, the bundle is preferably divided into two or more bundles, and placed in two or more holes. Appropriate indicia on the labeling lines 31 will adequately identify the yarn as to its use in the project. Conversely, there may be two different colors of yarn that comprise only one or two strands. Such colors may be grouped in one hole, such as the hole 19, so long as the colors can be readily differentiated by a visual inspection.

The foregoing description indicates that the card 11 needs to be reasonably stiff for convenient use of the yarn organizer 10. While the invention contemplates the use of a paper based card stock, it will be obvious to those skilled in the art that numerous other materials may be used. Plastics such as polyolefins, polycarbonates, acrylics and acrylic co-polymers can provide the characteristics desired and may be readily substituted for the card stock. Other substitutions will suggest themselves to those skilled in the art.

Looking at FIG. 4 for a detailed description of the embodiment of the invention here presented, it will be seen that the card 11 is made up of two sheets 34 and 35 bonded together. One thickness may also be used, but greater strength is generally provided by fastening two thicknesses together. If card stock is used, one might bond two 24 point pieces together. Different thicknesses might be used, but the 48 point board is adequate while minimizing the bulkiness of the material.

As is mentioned above, it is important that some indicia be provided to identify the individual yarns. For this purpose, the device here presented has a paper surface 36 bonded thereto. The paper for the surface 36 is selected to take markings by pencils or other readily available writing implements in order to simplify the labeling of the various holes. FIG. 4 indicates that a paper surface 38 is also provided on the back surface of the card 11. While this is not necessary, it improves the appearance of the card, and allows the labeling of the yarns on either side of the card 11.

The present invention therefore provides a yarn organizer for use with needlecraft projects. While the description has been primarily concerned with a kit, it will be understood that the invention is equally usable with any project, whether or not the project is in the form of a commercial kit.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. A yarn organizer, for organizing different colors of yarn for use in a needlecraft project, said organizer comprising a card having at least one edge, said card defining a plurality of holes therein adjacent to said at least one edge, each hole of said plurality of holes being adapted to receive a bundle of yarns therethrough and knotted between said hole and said at least one edge, said plurality of holes comprising holes of different sizes for receiving different sizes of bundles of yarn, each hole of said plurality of holes being spaced from said at least one edge by a predetermined distance that is equal for all holes of said plurality of holes, each hole of said plurality of holes being spaced from adjacent holes by a predetermined distance that is equal for all holes of said plurality of holes, said predetermined distance between holes being sufficient to maintain the strength of said card, and said plurality of holes being arranged with the smallest hole generally in the center of said card and increasing sizes of holes toward each end of said card.

2. A yarn organizer as claimed in claim 1, said card having a second edge generally parallel to said one edge, said card defining a second plurality of holes adjacent to said second edge, said plurality of holes being arranged with the smallest hole generally in the center of said card and increasing sizes of holes towards each end of said card, said second plurality of holes being arranged with the largest hole generally in the center of said card, and decreasing sizes of holes towards each end of said card, each hole of said plurality of holes being spaced from said one edge by a predetermined distance that is equal for all holes of said plurality of holes, each hole of said second plurality of holes being spaced from said second edge by a second predetermined distance that is equal for each hole of said second plurality of holes, said predetermined distance and said second predetermined distance being equal, each hole of said plurality of holes being spaced from adjacent holes of said plurality of holes by a third predetermined distance that is equal for all holes of said plurality of holes, each hole of said second plurality of holes being spaced from adjacent holes of said plurality of holes by a fourth predetermined distance that is equal for all holes of said second plurality of holes, said third predetermined distance and said fourth predetermined distance being equal.

3. A yarn organizer as claimed in claim 2, said card including a front surface adapted to receive writing for identification of the bundles of yarns.

4. A yarn organizer as claimed in claim 3, and further including a needle holding means on said front surface for holding at least one needle.

5. In combination, a needlecraft project wherein a plurality of different colors of yarn is required, each color of yarn of said plurality of different colors of yarn having a unique identification, various quantities of said different colors of yarn being required for completion of said project, and a yarn organizer for said plurality of different colors of yarn, said yarn organizer including a card having at least one edge, said card defining a plurality of holes therein adjacent to said at least one edge, each hole of said plurality of holes being adapted to receive one quantity of said various quantities of said yarn therethrough and knotted between said hole and said at least one edge, said plurality of holes comprising holes of different sizes for receiving different quantities of yarn, said card having a second edge generally parallel to said one edge, said card defining a second plurality of holes adjacent to said second edge, said plurality of holes being arranged with the smallest hole generally in the center of said card and increasing sizes of holes towards each end of said card, said second plurality of holes being arranged with the largest hole generally in the center of said card, and decreasing sizes of holes towards each end of said card.

6. The combination as claimed in claim 5, each hole of said plurality of holes being spaced from said one edge by a predetermined distance that is equal for all holes of said plurality of holes, each hole of said second plurality of holes being spaced from said second edge by a second predetermined distance that is equal for each hole of said second plurality of holes, said predetermined distance and said second predetermined distance being equal, each hole of said plurality of holes being spaced from adjacent holes of said plurality of holes by a third predetermined distance that is equal for all holes of said plurality of holes, each hole of said second plurality of holes being spaced apart from adjacent holes of said plurality of holes by a fourth predetermined distance that is equal for all holes of said second plurality of holes, said third predetermined distance and said fourth predetermined distance being equal.

7. The combination as claimed in claim 6, said card including a front surface adapted to receive writing for identification of said bundles of yarns, and needle holding means on said front surface for holding at least one needle.

8. A yarn organizer, for organizing different colors of yarn for use in a needlecraft project, said organizer comprising a card having at least one edge, said card defining a plurality of holes therein adjacent to said at least one edge, each hole of said plurality of holes being adapted to receive a bundle of yarns therethrough and knotted between said hole and said at least one edge, said plurality of holes comprising holes of different sizes for receiving different sizes of bundles of yarn, each hole of said plurality of holes being spaced from said at least one edge by a predetermined distance that is equal for all holes of said plurality of holes, each hole of said plurality of holes being spaced from adjacent holes by a predetermined distance that is equal for all holes of said plurality of holes, said predetermined distance between holes being sufficient to maintain the strength of said card, and said plurality of holes being arranged with the largest hole generally in the center of said card and decreasing sizes of holes toward each end of said card.

* * * * *